US009470483B1

(12) United States Patent
Wang

(10) Patent No.: US 9,470,483 B1
(45) Date of Patent: Oct. 18, 2016

(54) OIL SHAPED CHARGE FOR DEEPER PENETRATION

(71) Applicant: Zeping Wang, Katy, TX (US)

(72) Inventor: Zeping Wang, Katy, TX (US)

( * ) Notice: Subject to any disclaimer, the term of this patent is extended or adjusted under 35 U.S.C. 154(b) by 0 days.

(21) Appl. No.: 14/685,777

(22) Filed: Apr. 14, 2015

(51) Int. Cl.
*F42B 3/22* (2006.01)
*F42B 1/02* (2006.01)
*E21B 43/117* (2006.01)

(52) U.S. Cl.
CPC ..... *F42B 3/22* (2013.01); *E21B 43/117* (2013.01); *F42B 1/02* (2013.01)

(58) Field of Classification Search
CPC ..... F42B 1/02; F42B 1/028; F42B 3/08; F42B 12/10; F42B 3/22; F42B 3/00; E21B 43/116; E21B 43/117
USPC ..... 166/299; 102/476
See application file for complete search history.

(56) References Cited

U.S. PATENT DOCUMENTS 2,856,850 A * 10/1958 Church ..... F42B 1/02 102/307
3,235,005 A * 2/1966 Delacour ..... C06C 15/00 102/306
4,387,773 A * 6/1983 McPhee ..... F42B 3/08 102/306
4,724,767 A * 2/1988 Aseltine ..... F42B 1/02 102/307
5,221,808 A * 6/1993 Werner ..... F42B 1/032 102/283
5,413,048 A * 5/1995 Werner ..... F42B 1/032 102/307
5,597,974 A * 1/1997 Voreck, Jr. ..... C06B 45/00 102/275.5
6,668,726 B2 * 12/2003 Lussier ..... F42B 1/028 102/307
6,840,178 B2 * 1/2005 Collins ..... F42B 1/032 102/307
6,925,924 B2 * 8/2005 Baker ..... F42B 1/02 89/1.151
7,712,416 B2 * 5/2010 Pratt ..... F42B 1/032 102/307
8,459,186 B2 * 6/2013 Wang ..... E21B 43/117 102/306
2002/0129724 A1 * 9/2002 Clark ..... F42B 1/032 102/307
2009/0255433 A1 * 10/2009 Wang ..... E21B 43/117 102/307
2011/0056362 A1 * 3/2011 Yang ..... E21B 43/117 89/1.15

* cited by examiner

*Primary Examiner* — John D Cooper

(57) ABSTRACT

An oil shaped charge for deeper penetration includes a case, a quantity of explosive material, and a liner. The case is designed with different inner surface sections, where the step inner surface section creates maximum space for the explosive material so that the explosive material can be effectively placed between the case and the liner. A step conical region of the liner, a step conical inner surface of the case, and an effective placement of the explosive material are able to achieve significantly higher speeds for liner materials flow into the jet, thus creating deeper penetration.

11 Claims, 16 Drawing Sheets

DETAIL A

DETAIL B

DETAIL A

DETAIL A

DETAIL A

DETAIL A

DETAIL A

OIL SHAPED CHARGE FOR DEEPER PENETRATION

FIELD OF THE INVENTION

The present invention relates generally to the field of the oil and natural gas industry. More specifically, the present invention is a shaped charge that effectively penetrates the wellbore in order to create deeper penetrations so that the collection of the oil or natural gas can be maximized.

BACKGROUND OF THE INVENTION

The oil shaped charges have been widely used in the oil and natural gas industry for many years. Oil and natural gas flow into the wellbore through perforations in the cased wellbore as the perforations are usually performed using a perforating gun loaded with shaped charges.

In general, an oil shaped charge is made of a case, a liner and explosive. The case is mostly made of steel, zinc, aluminum, copper, ceramics, etc. The liner is composed of a few powder metals or solid metals. To increase penetrating capability, tungsten powder, which density is 19.3 gram/$cm^3$, is used as the main component in the mixed metal powder. Since the tungsten powder is a brittle-like metal material, copper powder is added to the mixed powder as an adhesive. After initiation of the shaped charge through an access hole, an explosive shock wave propagates toward into the inside explosive layer. Since the shock wave is compact with highly pressure, the liner is collapsed and forms a high speed jet so the high speed jet can penetrate a perforating gun and a casing. Then the high speed jet continuously penetrates into the rock layer where oil or natural gas is reserved.

The penetrating depth of the high speed jet in a rock layer depends on tip speed, and total effective length of the jet. The definition of the effective jet length is given by $(V_{tip}-V_{rear})\times t$, where $V_{tip}$, $V_{rear}$ and t are the tip speed, rear speed and time, respectively. Since the high speed jet is mostly made of metal powder, if the tip speed is too high, it disperses and therefore loses penetration capability. For the oil shaped charges, maximum speed can reach as high as 8000 m/sec or even higher, but usually the tip speed of a traditional oil shaped charge is in the range of 5500 m/sec through 6500 m/sec. Tests have shown that a high speed jet with the speed of 600 m/s can still penetrate a concrete target with strength greater than 5500 psi. However, for most of oil shaped charges, the rear speed is in the range of 1100 m/sec through 1300 m/sec. The X-ray tests show that after 1100 m/s, the rear of the high speed jets disperse and lose penetrating capability. In a traditional shaped charge, the effective length of the liner material is only one half of the liner total length and the effective explosive is also around half of the total weight. Additionally, the traditional shaped charge designs create large reverse tip velocity which wastes a lot of liner material and explosive. As a result, the total length of the high speed jet is relatively short and the penetrating capability is low.

It is therefore an objective of the present invention to provide a shaped charge design for super penetration by changing the configurations of the liner and the proper placement of the explosive material. For example, when the effective liner material and explosive are increased, the effective kinetic energy of the jet increases, which in turn increases penetration. The unique outer wall configuration of the linear and the unique inner wall configuration of the case allow the explosive material to be effectively placed in between the linear and case so that the maximum penetration can be achieved by the high speed jet.

DETAIL DESCRIPTIONS OF THE INVENTION

Figure 1:
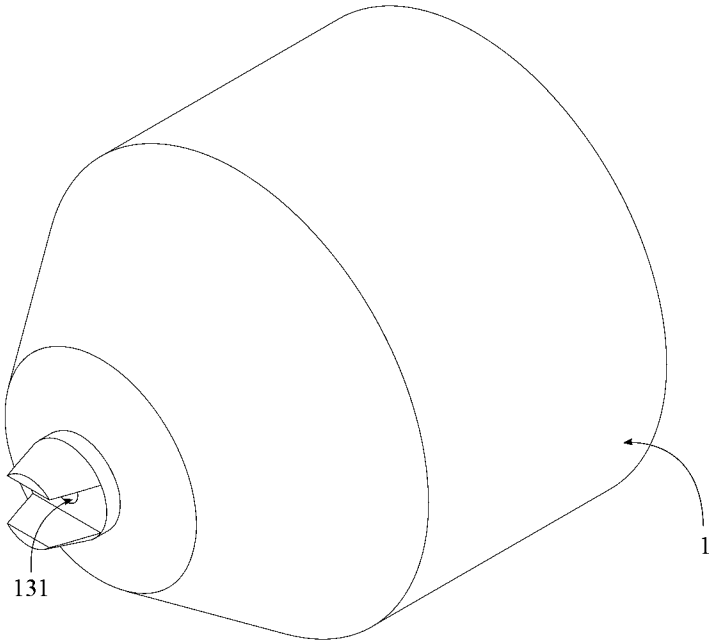
FIG. 1 is a perspective view of the present invention, showing the access hole of the present invention.
Figure 2:
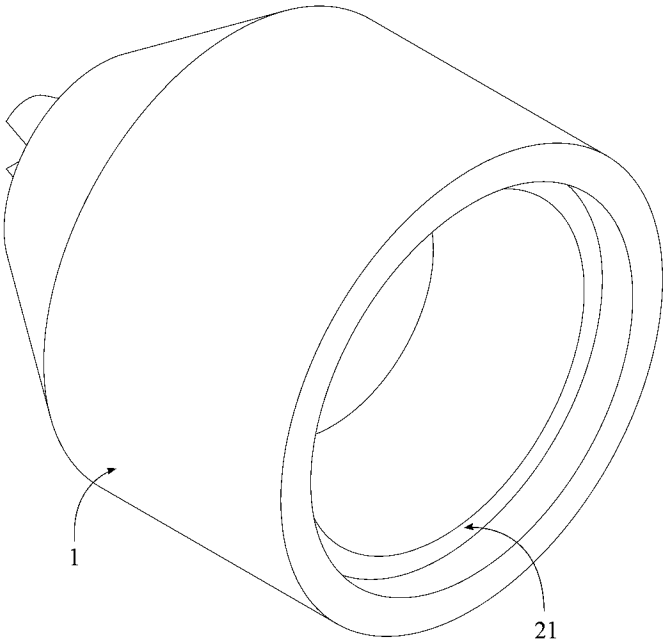
FIG. 2 is a perspective view of the present invention, showing the case and the liner of the present invention.

All illustrations of the drawings are for the purpose of describing selected versions of the present invention and are not intended to limit the scope of the present invention.

The present invention is an oil shaped charge for deeper penetration, as shown in FIG. 1-FIG. 4, where the present invention comprises a case 1, a quantity of explosive material 20, and a liner 21. The case 1 is made of metal such as variation steels, aluminum, copper and zinc. The quantity of explosive material 20 is preferably composed with material such as RDX (explosive nitroamine), HMX (insensitive nitroamine high explosive), HNS (high heat resistant explosive), etc. The liner 21 is preferably composed of powder metals of tungsten, copper, lead, bismuth, or solid metals etc. The length of the present invention is greater or equal to the length of the traditional oil shaped charge; however, the liner 21 and the case 1 are configured in a unique manner so that the present invention can efficiently place the quantity of explosive material 20 between the case 1 and the liner 21. In reference to the general configuration of the present invention, the case 1 and the liner 21 are radially positioned around a central axis 37 in such a way that the liner 21 is coaxially mounted within the case 1 along the central axis 37 and positioned offset from an inner surface 2 of the case 1. The quantity of explosive material 20 is radially interposed between the case 1 and the liner 21 as the quantity of explosive material 20 operatively connects with the liner 21 and the case 1 for the functionality of the present invention. A step conical inner surface 12 of the case 1 is adjacently positioned around a step conical region 31 of the liner 21 in order to maximize the placement of the quantity of explosive material 20, which in return maximizes the penetration of the high speed jet when the present invention explodes through the perforating gun.

The case 1 that retains the quantity of explosive material 20 and the liner 21 prior to the usage of the present invention shatters during the usage of the present invention so that the high speed jet can be created. In reference to FIG. 5-6, the case 1 comprises an access hole 131, a first conical inner surface 3, a second conical inner surface 10, a third conical inner surface 17, and a fourth conical inner surface 19 in addition to the step conical inner surface 12. More specifically, the access hole 131 allows the quantity of explosive material 20 to be access from outside and positioned around the tapered end of the case 1. The access hole 131 is adjacently positioned with the first conical inner surface 3 as the first conical inner surface 3 begins the inside configuration of the case 1. The second conical inner surface 10 is adjacently connected with the first conical inner surface 3 and oppositely positioned from the access hole 131 as the inner surface 2 of the case 1 continuous. The step conical inner surface 12 is adjacently connected with the second conical inner surface 10 as the step conical inner surface 12 is positioned opposite of the first conical inner surface 3. In order to maintain the continuous inner surface 2 of the case 1, the third conical inner surface 17 is adjacently connected with the step conical inner surface 12 and positioned opposite from the second conical inner surface 10. The fourth conical inner surface 19 is adjacently connected with the third conical inner surface 17 and oppositely positioned from the step conical inner surface 12 so that the inner surface 2 of the case 1 can be completed.

Figure 5:
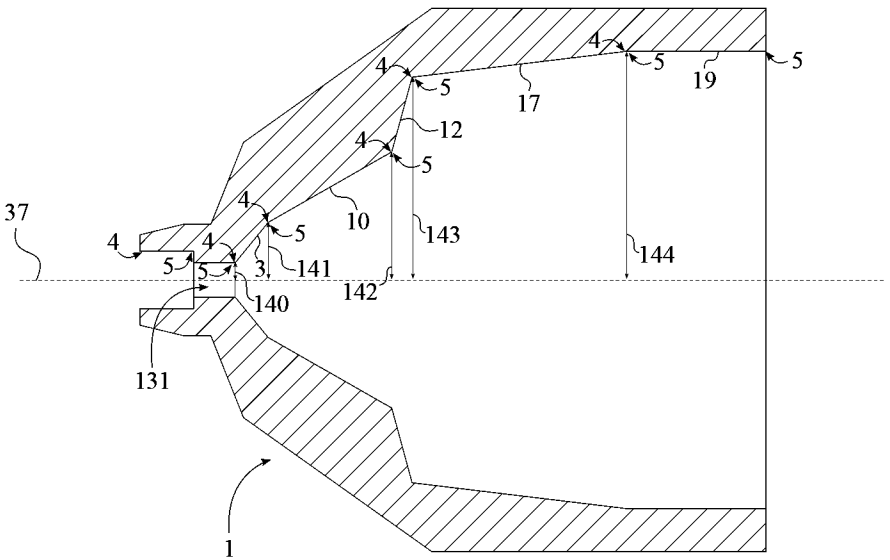
FIG. 5 is a cross-sectional view of the case for the preferred embodiment of the present invention, showing the plurality of radial distances of the case.
Figure 6:
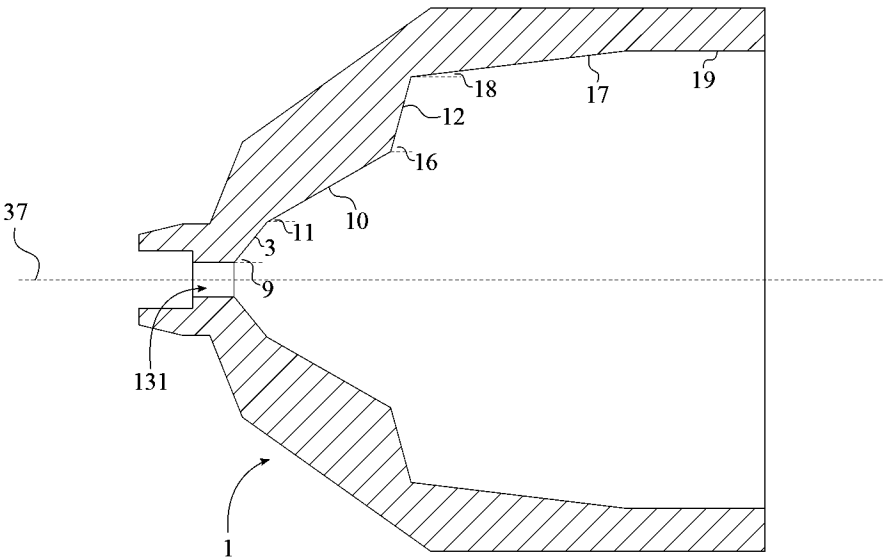
FIG. 6 is a cross-sectional view of the case for the preferred embodiment, showing the plurality of arc angles.

In reference to FIG. 5-6, the access hole 131, the first conical inner surface 3, the second conical inner surface 10, the step conical inner surface 12, the third conical inner surface 17, and the fourth conical inner surface 19 each comprise a first edge 4 and a second edge 5 as the configuration for the inner surface 2 of the case 1 is delineated through a plurality of radial distances. More specifically, a first radial distance 140 is extended from the first edge 4 of the first conical inner surface 3 to the central axis 37 while a second radial distance 141 is extended from the second edge 5 of the first conical inner surface 3 and the first edge 4 of the second conical inner surface 10 to the central axis 37. The second radial distance 141 is greater than the first radial distance 140 so that the first conical inner surface 3 is able to extend along the inner surface 2 of the case 1 with a first arc angle 9 as the first conical inner surface 3 and the central axis 37 are oriented with each other at the first arc angle 9. A third radial distance 142 is extended from the second edge 5 of the second conical inner surface 10 and the first edge 4 of the step conical inner surface 12 to the central axis 37, where the third radial distance 142 is greater than the second radial distance 141. Since the third radial distance 142 is greater than the second radial distance 141, the second conical inner surface 10 extends along the inner surface 2 of the case 1 with a second arc angle 11 as the second conical inner surface 10 and the central axis 37 are oriented with each other at the second arc angle 11. A fourth radial distance 143 is extended from the second edge 5 of the step conical inner surface 12 and the first edge 4 of the third conical inner surface 17 to the central axis 37, where the fourth radial distance 143 is greater than the third radial distance 142. Since the fourth radial distance 143 is greater than the third radial distance 142, the step conical inner surface 12 extends along the inner surface 2 of the case 1 with a step arc angle 16 as the step conical inner surface 12 and the central axis 37 are oriented with each other at the step arc angle 16. A fifth radial distance 144 is extended from the second edge 5 of the third conical inner surface 17 and the first edge 4 of the fourth conical inner surface 19 to the central axis 37, where the fifth radial distance 144 is greater than the fourth radial distance 143. Since the fifth radial distance 144 is greater than the fourth radial distance 143, the third conical inner surface 17 extends along the inner surface 2 of the case 1 with a third arc angle 18 as the third conical inner surface 17 and the central axis 37 are oriented with each other at the third arc angle 18. A sixth radial distance is extended from the second edge 5 of the fourth conical inner surface 19 to the central axis 37, where the sixth radial distance is preferably equal to the fifth radial distance 144. As a result, the fourth conical inner surface 19 extends parallel to the central axis 37.

Due to the increasing values of each of the redial distance, the inner surface 2 of the case 1 is formed into a general conical shape; however, each of the arc angles dictates the exact positioning of the first conical inner surface 3, the second conical inner surface 10, the step conical inner surface 12, the third conical inner surface 17, and the fourth conical inner surface 19 with respect to the central axis 37. The step conical inner surface 12 creates additional space for the quantity of explosive material 20 so that the liner 21 can achieve maximum penetration due to the increased quantity of explosive material 20.

Figure 17:
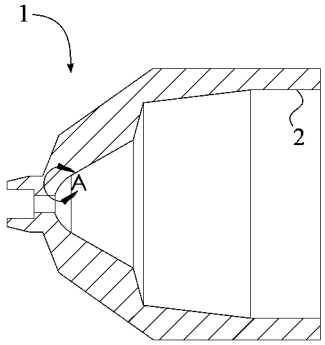
FIG. 17 is a cross-sectional view of the case, showing the plane upon which a detail view A is taken shown in FIG. 18.
Figure 18:
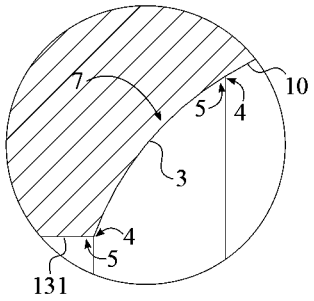
FIG. 18 is a detail view taken along line A of FIG. 17, showing the first alternative configuration of the first conical inner surface.
Figure 19:
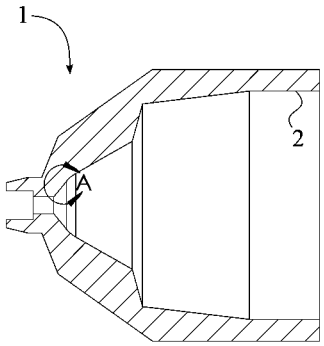
FIG. 19 is a cross-sectional view of the case, showing the plane upon which a detail view A is taken shown in FIG. 20.
Figure 20:
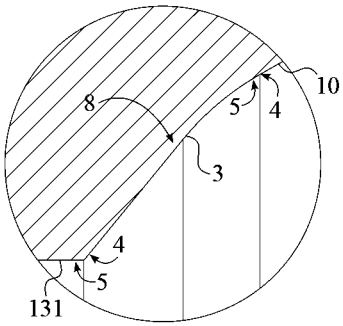
FIG. 20 is a detail view taken along line A of FIG. 19, showing the second alternative configuration of the first conical inner surface.

In reference to the first conical inner surface 3, the second edge 5 of the access hole 131 is adjacently positioned with the first edge 4 of the first conical inner surface 3 while the first edge 4 of the second conical inner surface 10 is adjacently positioned with the second edge 5 of the first conical inner surface 3 as the shape of the first conical inner surface 3 may change from one embodiment to another. In reference to FIG. 7-8, a linear surface 6 is illustrated as the preferred configuration of the first conical inner surface 3 between the second edge 5 of the access hole 131 and the first edge 4 of the second conical inner surface 10. A first alternative configuration of the first conical inner surface 3 is shown within FIG. 17-18, where the first conical inner surface 3 between the second edge 5 of the access hole 131 and the first edge 4 of the second conical inner surface 10 is an arc inside surface 7. A second alternative configuration of the first conical inner surface 3 is shown within FIG. 19-20, where the first conical inner surface 3 between the second edge 5 of the access hole 131 and the first edge 4 of the second conical inner surface 10 is an arc tangent surface 8.

Figure 7:
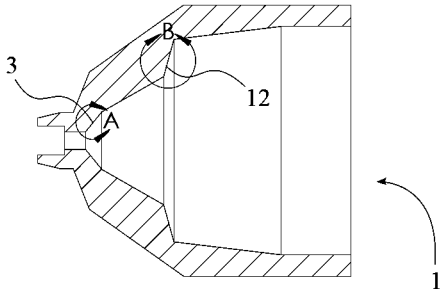
FIG. 7 is a cross-sectional view of the case for the preferred embodiment of the present invention, showing the plane upon which a detail view A and detail view B are taken shown in FIG. 8 and FIG. 9.
Figure 8:
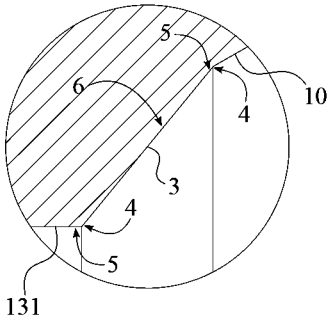
FIG. 8 is a detail view taken along line A of FIG. 7, showing the preferred configuration of the first conical inner surface.
Figure 9:
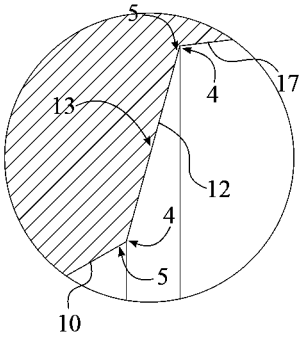
FIG. 9 is a detail view taken along line B of FIG. 7, showing the preferred configuration of the step conical inner surface.
Figure 21:
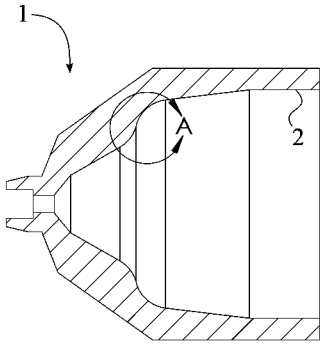
FIG. 21 is a cross-sectional view of the case, showing the plane upon which a detail view A is taken shown in FIG. 22.
Figure 22:
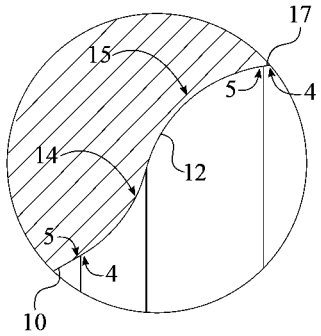
FIG. 22 is a detail view taken along line A of FIG. 21, showing the first alternative configuration of the step conical inner surface.
Figure 23:
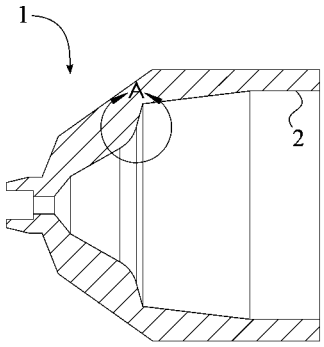
FIG. 23 is a cross-sectional view of the case, showing the plane upon which a detail view A is taken shown in FIG. 24.
Figure 24:
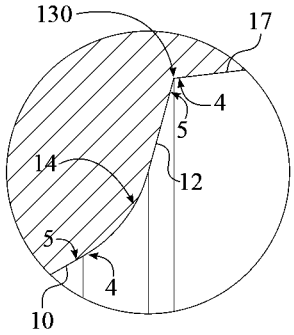
FIG. 24 is a detail view taken along line A of FIG. 23, showing the second alternative configuration of the step conical inner surface.
Figure 25:
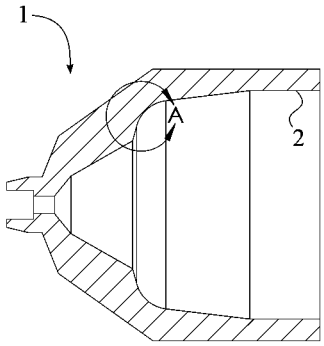
FIG. 25 is a cross-sectional view of the case, showing the plane upon which a detail view A is taken shown in FIG. 26.
Figure 26:
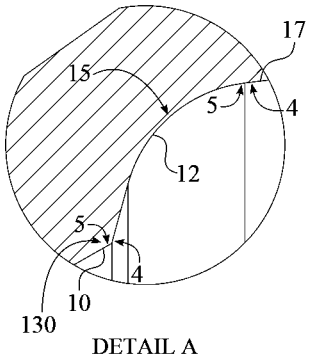
FIG. 26 is a detail view taken along line A of FIG. 25, showing the third alternative configuration of the step conical inner surface.

In reference to step conical inner surface 12, the second edge 5 of the second conical inner surface 10 is adjacently positioned with the first edge 4 of the step conical inner surface 12 while the first edge 4 of the third conical inner surface 17 is adjacently positioned with the second edge 5 of the step conical inner surface 12 as the shape of the step conical inner surface 12 may change from one embodiment to another. More specifically, the FIG. 7 and FIG. 9 illustrate a linear surface 13 as the preferred configuration of the step conical inner surface 12 between the second edge 5 of the second conical inner surface 10 and the first edge 4 of the third conical inner surface 17. A first alternative configuration of the step conical inner surface 12 is shown within FIG. 21-22, where a first interface between the second edge 5 of second conical inner surface 10 and the first edge 4 of the step conical inner surface 12 is a concave-up surface 14 while a second interface between the first edge 4 of third conical inner surface 17 and the second edge 5 of the step conical inner surface 12 is a concave-down surface 15. A second alternative configuration of the step conical inner surface 12 is shown within FIG. 23-24, where the first interface between the second edge 5 of second conical inner surface 10 and the first edge 4 of the step conical inner surface 12 is a concave-up surface 14 while the second interface between the first edge 4 of third conical inner surface 17 and the second edge 5 of the step conical inner surface 12 is a pointed edge 130. A third alternative configuration of the step conical inner surface 12 is shown within FIG. 25-26, where the first interface between the second edge 5 of second conical inner surface 10 and the first edge 4 of the step conical inner surface 12 is a pointed edge 130 while the second interface between the first edge 4 of third conical inner surface 17 and the second edge 5 of the step conical inner surface 12 is a concave-down surface 15.

Figure 11:
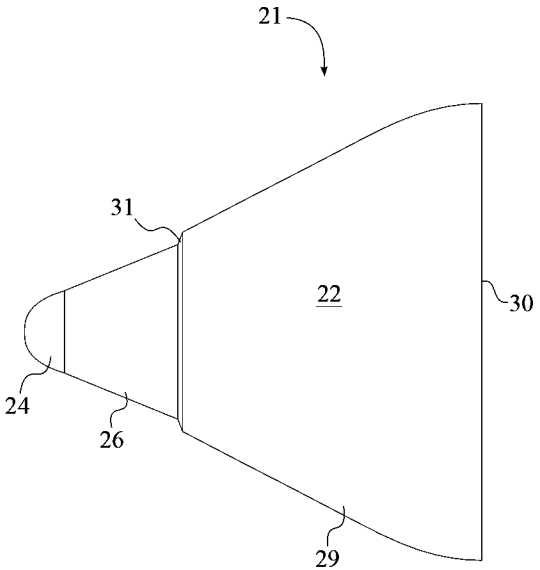
FIG. 11 is a side view of the liner for the preferred embodiment of the present invention.
Figure 10:
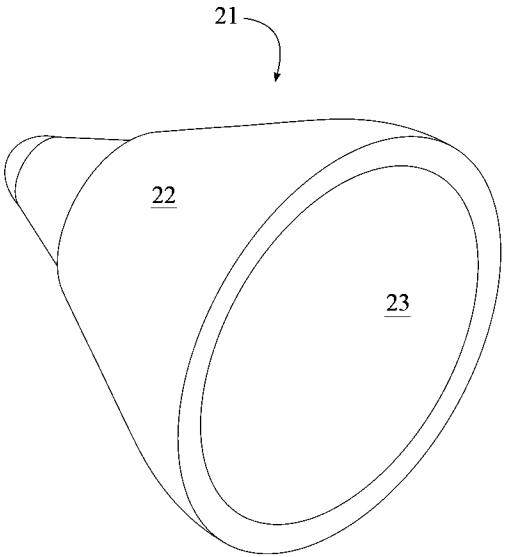
FIG. 10 is a perspective view of the liner for the preferred embodiment of the present invention.

The liner 21 transforms into the high speed jet during the blast of the present invention so that the wellbore can be penetrated through the present invention. In reference to FIG. 10-12, the overall shape of the liner 21 comprises a tip conical region 24, a front conical region 26, a rear conical region 29, and a step conical region 31, where the wall thickness along an outer surface 22 and an inner surface 23 of the liner 21 changes in order to maximize the penetration of the high speed jet. In reference to FIG. 3, the tip conical region 24 is adjacently positioned with the access hole 131 as the liner 21 is expanded away from the central axis 37 in order to create the general conical shape. The front conical region 26 is adjacently positioned with the tip conical region 24 opposite of the access hole 131. The step conical region 31, which absorbs the maximum amount of energy through the ignition, is adjacently positioned with the front conical region 26 opposite of the tip conical region 24. The rear conical region 29 that deforms into the main part of the high speed jet is adjacently positioned with the step conical region 31 opposite of the front conical region 26. The inner surface 23 of the liner 21 can comprise a straight line surface, a circular arc surface, an ellipse arc surface, or a parabola arc surface.

Figure 12:
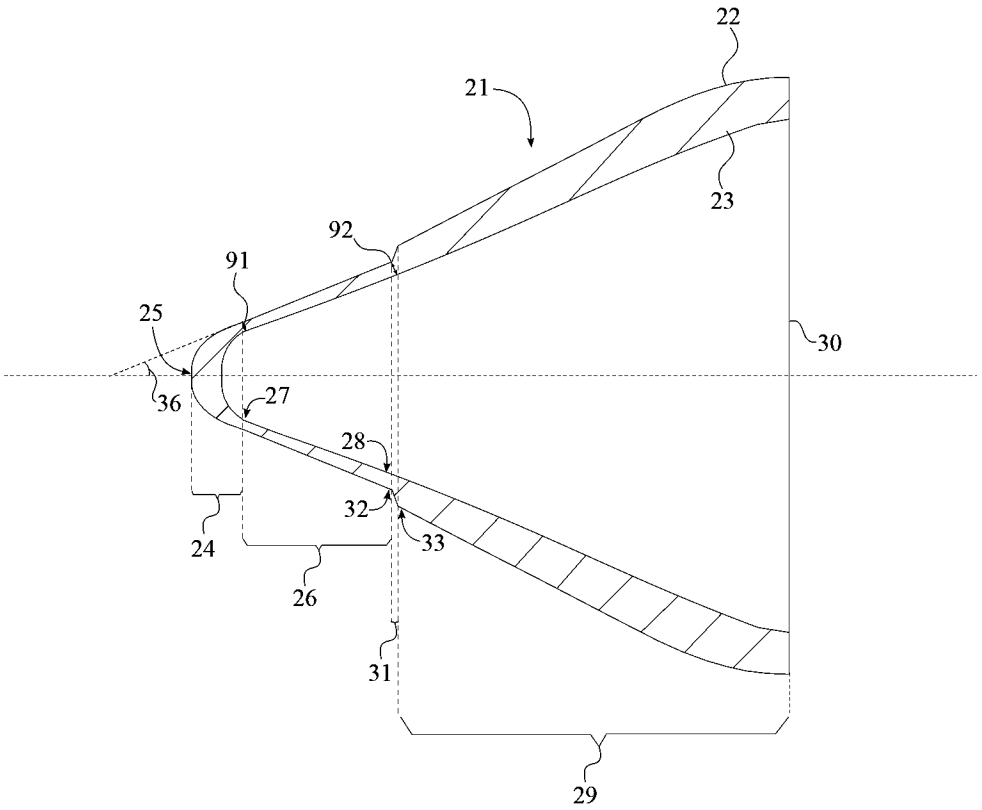
FIG. 12 is a cross-sectional view of the liner for the preferred embodiment of the present invention.

An average wall thickness of the liner 21 is extended between the outer surface 22 and the inner surface 23 of the liner 21. The average wall thickness changes along the liner 21 in order to maximize the effective length of the high speed jet so that the present invention can increase effective liner 21 material while increasing the quantity of explosive material 20. More specifically, the average wall thickness of the tip conical region 24 along the central axis 37 is greater than the average wall thickness for a front end 27 of the front conical region 26. The purpose of thicker tip conical region 24 is that when pressing the liner 21, the tip conical region 24 can bear much more force without damaging the liner die. However, the average wall thickness of the rear conical region 29 is greater than the average wall thickness of the tip front conical region 24 as the high speed jet is mainly shaped through the rear conical region 29. Depending on different embodiment, the average wall thickness of a front end 27 for the front conical region 26 is either equal to or less than the average wall thickness of a rear end 28 for the front conical region 26. Within the present invention, a front wall thickness 91 of the front end 27 is equal or less than a rear wall thickness 92 of the rear end 28 of the liner 21 as shown in FIG. 12. Preferably, the average wall thickness of the rear end 28 for the front conical region 26 and the average wall thickness of the rear conical region 29 have a ratio of 0.1 to 0.99. The outer surface 22 of the front conical region 26 and the central axis 37 are oriented with each other at a front region arc angle 36 as the front region arc angle 36 and the second arc angle 11 interposed majority of the quantity of explosive material 20.

Figure 13:
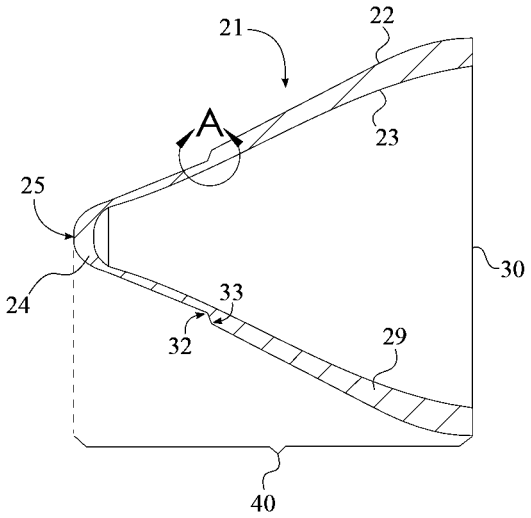
FIG. 13 is a cross-sectional view of the liner for the preferred embodiment of the present invention, showing the plane upon which a detail view A is taken shown in FIG. 14.
Figure 14:
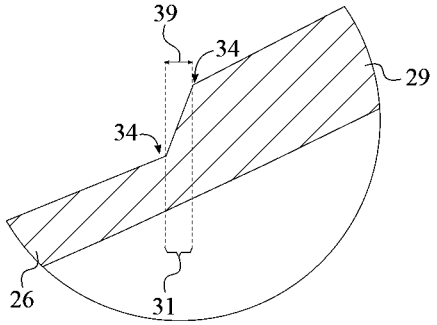
FIG. 14 is a detail view taken along line A of FIG. 13, showing the pointed edges of the step conical region.
Figure 15:
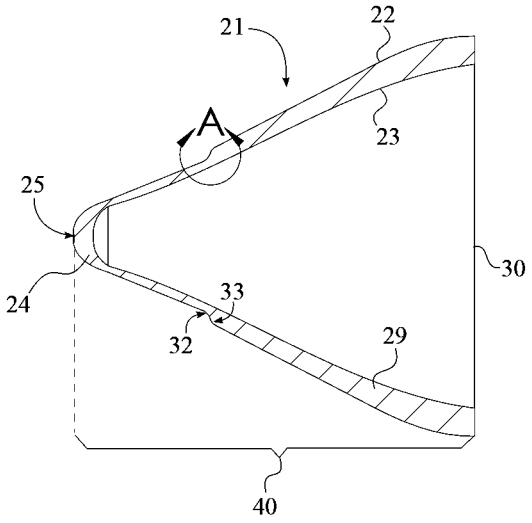
FIG. 15 is a cross-sectional view of the liner for the preferred embodiment of the present invention, showing the plane upon which a detail view A is taken shown in FIG. 15.
Figure 16:
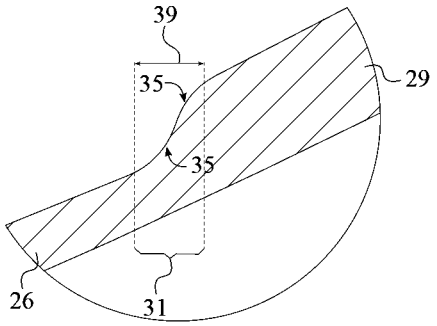
FIG. 16 is a detail view taken along line A of FIG. 16, showing the tangent edges of the step conical region.

The step conical region 31, which differentiates the average wall thickness of the front conical region 26 and the rear conical region 29, comprises a first rim 32 and a second rim 33. The first rim 32 of the step conical region 31 is adjacently positioned with the front conical region 26, and the second rim 33 of the step conical region 31 is adjacently positioned with the rear conical region 29. The first preferred configurations of the step conical region 31 are shown in FIG. 13-14, where the first rim 32 and the second rim 33 of the step conical region 31 are pointed edges 34. The second preferred configurations of the step conical region 31 are shown in FIG. 15-16, where the first rim 32 and the second rim 33 of the step conical region 31 are tangent edges 35. Additionally, a step width 39 is extended from the first rim 32 of the step conical region 31 to the second rim 33 of the step conical region 31 along the central axis 37 while an overall length 40 is extended from an apex end 25 of the tip conical region 24 to a rim 30 of the rear conical region 29 along the central axis 37. The step width 39 is in the range of 0.01 to 0.7 of the overall length 40 within the present invention so that the step conical region 31 can bear increased amount of force from the detonation of the quantity of explosive material 20 without damaging the liner 21 or compromising the structural integrity of the step conical region 31.

The quantity of explosive material 20 operatively connects with the liner 21 and the case 1 for the functionality of the present invention as the liner 21 is coaxially mounted within the case 1 along the central axis 37. In reference to FIG. 3, the first conical inner surface 3 is radially positioned around the tip conical region 24 as the first conical inner surface 3 is adjacently positioned with the tip conical region 24. Additionally, a section of the second conical inner surface 10 is also radially positioned around the tip conical region 24. In other words, the first conical inner surface 3 and the second conical inner surface 10 are both jointly and radially positioned adjacent to the tip conical region 24 so that the tip conical region 24 can be completely covered. In reference to FIG. 3, the second conical inner surface 10 and the step conical inner surface 12 are radially positioned around the front conical region 26 while the step conical inner surface 12 is positioned adjacent to the step conical region 31. Similarly, the third conical inner surface 17 is radially positioned around the step conical region 31 and the rear conical region 29 while the fourth conical inner surface 19 is radially positioned around the rear conical region 29.

The wall thickness of the liner of the traditional shaped charge gradually increases from a top end to a bottom end. The thickness of the explosive distribution in the case of the traditional shaped charge is from the maximum to minimum, where maximum explosive is placed adjacent to the top end and minimum explosive is placed adjacent to the bottom end. Because of the geometric designs of the liner and case of the traditional shaped charge, the tip velocity of the jet formed by the traditional shaped charge has a sequence reverse profile, for example, the later particle has higher speed than that of the front particle. This condition occurs all along the liner of the traditional shaped charge from the tip portion of the top end until to around the middle area of the liner. Due to the reversed velocity effect, the tip speed of the jet is seriously reduced. Likewise, the liner material from the top end to middle area is mostly wasted, for example, almost 20% of the liner material is lost. Meanwhile half weight of the explosive, which drives the wasted liner material, is also wasted. In general, the effective jet is formed from the middle area of liner until the bottom end, which is around 80% of total liner weight. The effective explosive is only 50% of the total explosive weight. On the other hand, since the explosive thickness around the middle area of the traditional shaped charge is significantly thinner than the quantity of explosive material 20 the present invention adjacent to the step conical inner surface 12 and the step conical region 29, the effective tip speed of the traditional shape charge is significantly lower. Therefore the effective total length of the jet formed from the traditional shaped charge is shorter compare to the present invention.

The front wall thickness 91 of the front end 27 and the rear wall thickness 92 of the rear end 28 in the front conical region 26 is relatively thin in order to increase effective liner 21 material within the present invention compare to the traditional shaped charge. The sudden increment of the quantity of explosive material 20 acts on the liner 21 and creates stronger force and longer acting time. The inner surface 22 of the front conical region 26 is composed of a straight line, or a circular arc, or ellipse arc, or parabola arc surface. The collapse angles gradually increase along with the inner surface 22 of the front conical region 26 from the front end 27 through the rear end 28. It is well known that a larger collapse angle forms lower velocity in the jet, but more mass flows into the jet. A shock disperses when it propagates in the void contained material. The thicker a void contained material is, the more a shock wave disperses. Since the wall thickness for the front conical region 26 of the present invention design is significantly thinner than that of a traditional design in the similar region, to reach the similar axis velocity, smaller amount for the quantity of explosive material 20 is required within the present invention. If the same amount for the quantity of explosive material 20 as the traditional shaped charge is applied to the present invention, the particles in the front conical region 26 disperses due to excess power applied and then lose the capability of penetration. It is expected that the tip region of the jet formed by the front conical region 26 from the front end 27 to rear end 28 penetrates the wall of perforating gun or even penetrate through the wellbore casing wall.

Figure 3:
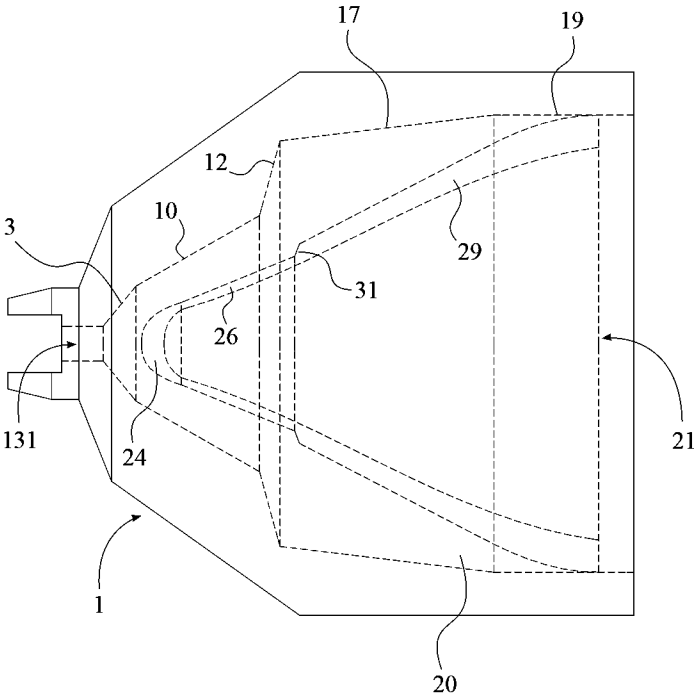
FIG. 3 is a side view of the preferred embodiment of the present invention, wherein the dash lines indicate the inner components within the case.
Figure 4:
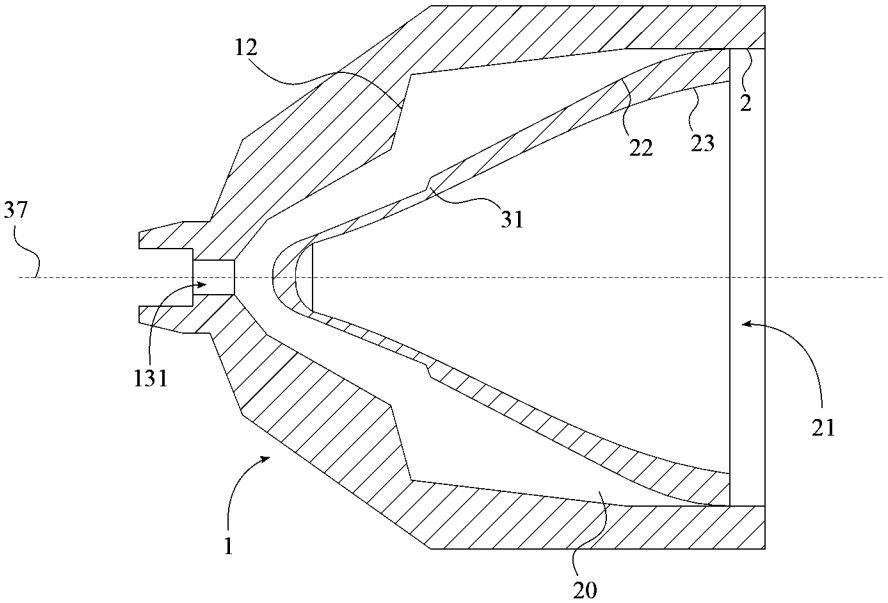
FIG. 4 is a cross-sectional view of the preferred embodiment of the present invention, showing the case and the liner.

In the present invention, the saved amount for the quantity of explosive material 20 is compare to the traditional shaped charge is added in between the rear conical region 29 and the third conical inner surface 17 after the step conical region 31 as shown in FIG. 3. In the same way, saved liner 21 material from the front conical region 26 is added into the rear conical region 29. If the quantity of explosive material 20 after the step conical region 31 is the same as the traditional shaped charge, the axis velocity in the jet is significantly lower than that of the traditional shaped charge due to more liner 21 mass in the rear conical region 29. However, since the quantity of explosive material 20 driving the liner 21 in the front conical region 26 of the present invention is much larger than that of the traditional shaped charge, the axis velocity is faster than the traditional shaped charge. Furthermore, the thicker wall of the rear conical region 29 passes much more mass with high velocity into the jet so that the jet is able extend longer and carry more kinetic energy. Overall, the penetration of the present invention is much deeper than that of the traditional shaped charge.

Under the action of the quantity of explosive material 20, the liner 21 is collapsed to form a jet which is composed of a slug, an effective jet, and a tip region. Among the jet, the effective jet and the tip region are formed from the rear conical region 29 and the front conical region 26 of the liner 21, respectively. Relatively increased amount for the quantity of explosive material 20 after the step conical region 31 flows much more high speed liner 21 material into the jet. The initial formation of the jet in which there is an obvious mass step change from the tip region to the effective jet due to mass change of the step conical region 31 in the liner 21. After the mass step change area, the high speed material in the jet increases a lot compare to the traditional shaped charge, where the mass step change area becomes longer and smooth. Therefore the jet formed from the present invention has much more high speed mass and kinetic energy. The jet formed by the present invention is longer than that of the traditional shaped charge. It therefore results in a deeper penetration in the target as more mass in the effective jet area increases the penetration capability.

Although the invention has been explained in relation to its preferred embodiment, it is to be understood that many other possible modifications and variations can be made without departing from the spirit and scope of the invention as hereinafter claimed.

What is claimed is:

1. An oil shaped charge for deeper penetration comprises:

a case;

a quantity of explosive material;

a liner;

the case comprises a first conical inner surface, a second conical inner surface, a step conical inner surface, a third conical inner surface, and a fourth conical inner surface;

the liner comprises a tip conical region, a front conical region, a rear conical region, and a step conical region;

the case and the liner being radially positioned around a central axis;

the liner being coaxially mounted within the case along the central axis and offset from an inner surface of the case;

the step conical inner surface being adjacently positioned around the step conical region;

the quantity of explosive material being radially interposed between the case and the liner;

the step conical inner surface, the third conical inner surface, and the fourth conical inner surface each comprise a first edge and a second edge;

a third radial distance being extended from the second edge of the second conical inner surface and the first edge of the step conical inner surface to the central axis;

a fourth radial distance being extended from the second edge of the step conical inner surface and the first edge of the third conical inner surface to the central axis;

the fourth radial distance being greater than the third radial distance;

an average wall thickness of the liner being extended between an outer surface and an inner surface of the liner;

the average wall thickness of the rear conical region being greater than the average wall thickness of the tip conical region;

the wall thickness of a rear end for the front conical region and the average wall thickness of the rear conical region have a ratio of 0.10 through 0.99;

a step width being extended from a first rim of the step conical region to a second rim of the step conical region along the central axis; and an overall length being extended from an apex end of the tip conical region to a rim of the rear conical region along the central axis rear conical region along the central axis; and the step width being ranged between 0.01 of the overall length to 0.7 of the overall length.

2. The oil shaped charge for deeper penetration as claimed in claim 1 comprises:

the step conical inner surface being adjacently connected with the second conical inner surface and oppositely positioned from the third conical inner surface.

3. The oil shaped charge for deeper penetration as claimed in claim 1 comprises:

the second conical inner surface and the central axis being oriented with each other at a second arc angle; and the step conical inner surface and the central axis being oriented with each other at a step arc angle, wherein the step arc angle is greater than the second arc angle.

4. The oil shaped charge for deeper penetration as claimed in claim 1 comprises:

the second conical inner surface, the step conical inner surface, and the third conical inner surface each comprise a first edge and a second edge;

the second edge of the second conical inner surface being adjacently positioned with the first edge of the step conical inner surface; and the first edge of the third conical inner surface being adjacently positioned with the second edge of the step conical inner surface.

5. The oil shaped charge for deeper penetration as claimed in claim 4, the step conical inner surface between the second edge of the second conical inner surface and the first edge of the third conical inner surface is a linear surface;

a first interface between the second edge of second conical inner surface and the first edge of the step conical inner surface being a concave-up surface; and a second interface between the first edge of third conical inner surface and the second edge of the step conical inner surface being a concave-down surface.

6. The oil shaped charge for deeper penetration as claimed in claim 4 comprises:

a first interface between the second edge of second conical inner surface and the first edge of the step conical inner surface being a concave-up surface; and a second interface between the first edge of third conical inner surface and the second edge of the step conical inner surface being a pointed edge.

7. The oil shaped charge for deeper penetration as claimed in claim 4 comprises:

a first interface between the second edge of second conical inner surface and the first edge of the step conical inner surface being a pointed edge; and a second interface between the first edge of third conical inner surface and the second edge of the step conical inner surface being a concave-down surface.

8. The oil shaped charge for deeper penetration as claimed in claim 1 comprises:

the step conical region comprises a first rim and a second rim;

the first rim being adjacently positioned with the front conical region; and the second rim being adjacently positioned with the rear conical region.

9. The oil shaped charge for deeper penetration as claimed in claim 8, wherein the first rim and the second rim are pointed edges.

10. The oil shaped charge for deeper penetration as claimed in claim 8, wherein the first rim and the second rim are tangent edges.

11. The oil shaped charge for deeper penetration as claimed in claim 1 comprises:

the step conical inner surface being radially positioned around the front conical region and positioned adjacent to the step conical region; and the third conical inner surface being radially positioned around the step conical region and the rear conical region.

* * * * *